US010711439B2

(12) United States Patent
Arens et al.

(10) Patent No.: US 10,711,439 B2
(45) Date of Patent: Jul. 14, 2020

(54) FLUSHING DEVICE FOR A SANITARY DEVICE AND TOILET OR URINAL FLUSH

(71) Applicant: Viega Technology GmbH & Co. KG, Attendorn (DE)

(72) Inventors: Klaus Arens, Wenden (DE); Tobias Klosta, Siegen (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 0 days.

(21) Appl. No.: 16/477,959

(22) PCT Filed: Jan. 19, 2018

(86) PCT No.: PCT/EP2018/051327

§ 371 (c)(1),
(2) Date: Jul. 15, 2019

(87) PCT Pub. No.: WO2018/145878

PCT Pub. Date: Aug. 16, 2018

(65) Prior Publication Data

US 2019/0368169 A1 Dec. 5, 2019

(30) Foreign Application Priority Data

Feb. 8, 2017 (DE) ..... 20 2017 100 660 U

(51) Int. Cl.
*E03B 7/08* (2006.01)
*E03D 1/30* (2006.01)
*E03D 5/10* (2006.01)

(52) U.S. Cl.
CPC ..... *E03B 7/08* (2013.01); *E03D 1/30* (2013.01); *E03D 5/10* (2013.01)

(58) Field of Classification Search
CPC ..... E03D 1/30
See application file for complete search history.

(56) References Cited

U.S. PATENT DOCUMENTS 3,498,131 A 3/1970 Rickey
4,980,933 A 1/1991 Tsutsui et al.
(Continued)

FOREIGN PATENT DOCUMENTS

CN 1041629 A 4/1990
CN 101685312 A 3/2010
DE 102004033770 A1 2/2006
DE 102008047938 A1 4/2010
(Continued)

*Primary Examiner* — Henry T Crenshaw
(74) *Attorney, Agent, or Firm* — The Webb Law Firm

(57) ABSTRACT

The invention relates to a flushing system for a sanitary device, in particular a toilet flushing or a urinal flushing, comprising a cold water supply line (6), a warm water supply line (8), a valve arrangement (10) for admitting the water flowing through the cold water line (6) and the warm water line (8), and a water discharge line (12) for discharging the water admitted by the valve arrangement (10). Said flushing device simplifies, and preferably improves the technical problem, that is, compliance with quality criteria for the supply of cold water and hot water with regard to the water consumption in such a way that at least one temperature sensor (14, 16) for measuring the water temperature in the cold water supply line (6) and/or or in the warm water supply line (8) is provided, and for generating at least one temperature signal (T1, T2), according to the invention, a control (18) for actuating the valve arrangement (10) depending on the temperature signal (T1, T2) generates a control signal (S; S1, S2), and the valve arrangement (10) discharges water through the water discharge line (12) depending on the control signal (S; S1, S2). The invention further relates to a toilet flushing and to a urinal flushing.

11 Claims, 3 Drawing Sheets

(56) References Cited

U.S. PATENT DOCUMENTS

Figure 1:
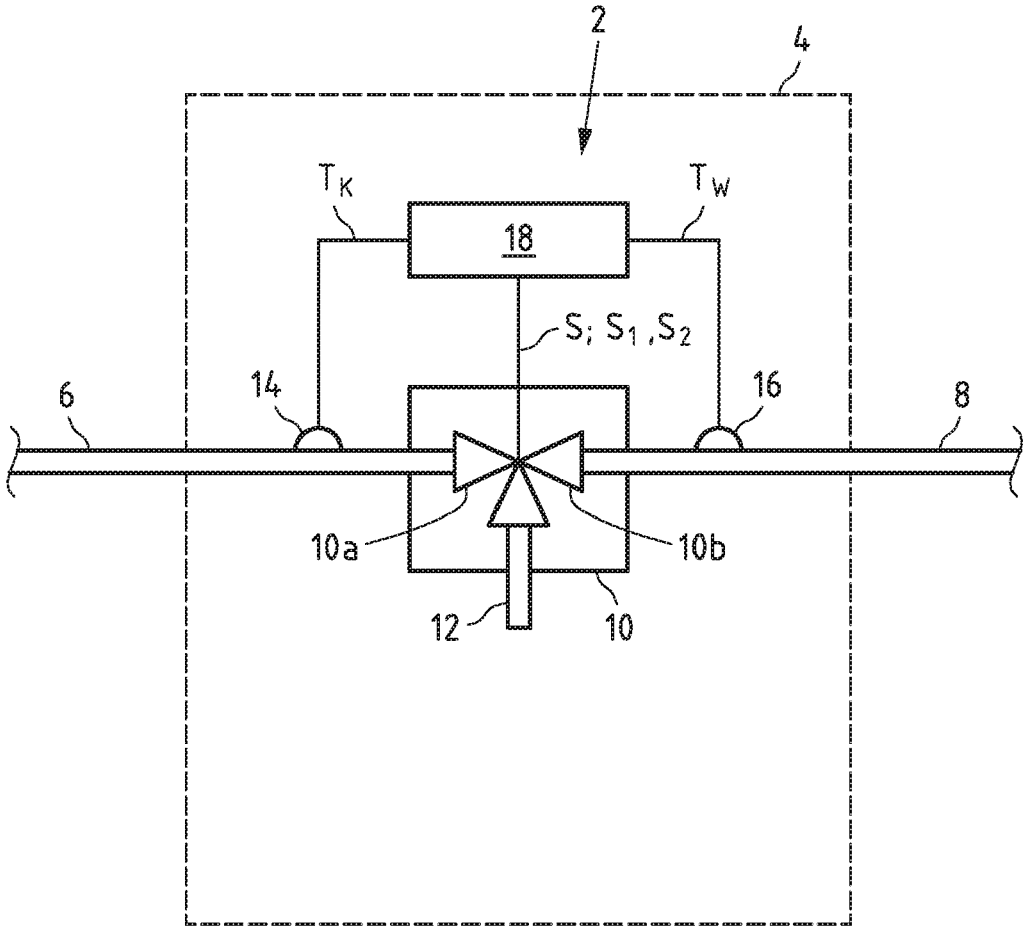

| | | | | |
|---|---|---|---|---|
| 6,061,843 | A | 5/2000 | Rump et al. | |
| 6,321,773 | B1 * | 11/2001 | Ramsby | E03B 7/08 134/166 C |
| 9,695,577 | B2 | 7/2017 | Leymann et al. | |
| 2004/0173688 | A1 * | 9/2004 | Gloodt | E03C 1/04 236/12.11 |
| 2005/0121529 | A1 * | 6/2005 | DeLangis | G05D 23/1393 236/12.12 |
| 2010/0078491 | A1 | 4/2010 | Aoyagi et al. | |
| 2012/0234398 | A1 * | 9/2012 | Leymann | E03B 7/006 137/15.05 |
| 2014/0020166 | A1 * | 1/2014 | Metcalf | E03D 13/007 4/301 |
| 2014/0189949 | A1 * | 7/2014 | Kelbassa | G01N 1/2035 4/670 |

FOREIGN PATENT DOCUMENTS

| | | | |
|---|---|---|---|
| DE | 102010055176 | A1 | 7/2012 |
| DE | 102011013955 | A1 | 9/2012 |
| DE | 202012102881 | U1 | 1/2013 |
| DE | 202013104471 | U1 | 12/2013 |
| DE | 20 2014 105 702 | * | 11/2014 |
| DE | 202014008946 | U1 | 1/2015 |
| DE | 202014104154 | U1 | 1/2015 |
| DE | 202014105702 | U1 | 1/2015 |
| EP | 0675234 | A1 | 10/1995 |
| EP | 2500475 | A2 | 9/2012 |
| EP | 2722449 | A1 | 4/2014 |
| GB | 2146675 | A | 4/1985 |
| GB | 2361483 | A | 10/2001 |
| GB | 2396163 | A | 6/2004 |
| GB | 2478124 | A | 8/2011 |
| KR | 20010107001 | A | 12/2001 |

* cited by examiner

FLUSHING DEVICE FOR A SANITARY DEVICE AND TOILET OR URINAL FLUSH

CROSS-REFERENCE TO RELATED APPLICATIONS

This application is the United States national phase of International Application No. PCT/EP2018/051327 filed Jan. 19, 2018, and claims priority to German Utility Model Application No. 20 2017 100 660.3 filed Feb. 8, 2017, the disclosures of which are hereby incorporated by reference in their entirety.

The invention relates to a flushing device for a sanitary device, in particular a toilet flush or an urinal flush, with a cold water supply line, with a hot water supply line, with a valve arrangement for admitting the water flowing in through the cold water line and the hot water line, with a water drain for draining the water admitted by the valve arrangement, wherein at least one temperature sensor is provided for measuring the water temperature in the cold water supply line and/or the hot water supply line and for generating at least one temperature signal, wherein a controller for actuating the valve arrangement generates a control signal as a function of the temperature signal and wherein the valve assembly drains water through the water drain depending on the control signal. The invention also relates to a toilet flush and an urinal flush.

Drinking water installations are subject to strict requirements for the quality of the hot and cold water contained in the drinking water system in order to guarantee hygienically clean drinking water. In particular, the standby of cold and hot water in the pipes must be avoided. This is because both heating the cold water and cooling the hot water to room temperature in the range of 15° C. to 25° C. can result in water temperatures over a longer period of time, which promote the multiplication of germs, in particular *Legionella.*

One way of complying with the quality requirements is to circulate the cold water and/or the hot water in circulation systems so that continuous circulation of the water in the pipe system can prevent stagnation and temperature equalisation.

An alternative option is to place a flushing station at the respective ends of a water pipeline, for example at the end of a floor of a residential building or hospital. The flushing station allows cold and/or warm water to be drained into a separate drain in order to replace the water in the respective pipe.

In a cold water flushing station, it is known that a toilet flush makes it possible to drain water from a cold water pipe. The flushing technology is equipped with a time switch and the flushing station is activated after the last flush if a preset time interval is exceeded. This mechanism ensures that the same amount of cold water is always removed from the cold water line at the same maximum intervals for refilling the cistern.

In addition, a flushing station is known where a cold water pipe and a hot water pipe are connected. By means of a mixing valve, water is drained into the cistern during a manually activated flushing process. In this case, the water pipes are only flushed when the cistern is operated manually. Long standbys are hence not avoided.

Therefore, the present invention is based on the technical problem of simplifying compliance with quality criteria for the supply of cold and/or hot water and preferably improving it in terms of water consumption.

The above-mentioned technical problem is solved in accordance with the invention by a flushing device for a sanitary device, in particular a toilet flush or an urinal flush of the type mentioned above, in that the controller transmits the control signal to a cistern valve arrangement, and in that the water drain triggered by the cistern valve arrangement actuates the valve arrangement.

Thus a flushing device is indicated which only carries out a flushing process of the supplied cold water pipe and/or hot water pipe if the measured temperature curve makes this flushing process necessary. On the one hand, this means that necessary flushing processes are carried out more frequently than at a given time rhythm, especially in the case of extreme environmental influences caused by high or low room temperatures. On the other hand, at normal room temperatures less frequent flushing processes are carried out than at a given time rhythm. In addition, both cold and warm water lines can be designed to be independently verifiable by temperature sensors and can be flushed with the described flushing device to the exact extent necessary to maintain a high water quality, while at the same time minimizing water and energy consumption.

For this purpose, the temperature signal(s) are evaluated in the controller and the corresponding control signal is output according to a specified algorithm.

The valve arrangement preferably has two separate valves which are controlled separately by the control signal or by an assigned control signal, i.e. opened or closed. For this purpose, the valves are designed with an electric motor and can therefore be controlled independently of each other. Alternatively, the valve arrangement can be designed as a mixing valve, so that water with a predeterminable temperature can be drained with a control signal over the water outlet. The mixing valve can be equipped with an expansion element or electrically operated. When used with an expansion element, there is no need for an electrical power supply; the expansion element is then mechanically set to a specified temperature. When used with an electric actuator, the mixing valve can be controlled more accurately and variably.

In addition, the temperature sensor measures the temperature of the water in the cold water supply line and the controller generates the control signal when the water temperature exceeds a first temperature limit value. Thus, if the water in the cold water pipe heats up excessively, the flushing device will be flushed into a sanitary facility.

Alternatively or in addition, the temperature sensor or another temperature sensor can measure the temperature of the water in the hot water supply line and the controller can generate the control signal if the water temperature falls below a temperature limit value. Thus, excessive cooling of the hot water is detected and eliminated by flushing the flushing device into a sanitary facility.

In a preferred way, the control system generates the control signal depending on the duration of exceeding or falling below the first or second temperature limit value. Thus too frequent flushing processes are avoided in the case of fluctuations of the temperature signal around the respective temperature limit value.

Furthermore, it is preferred that the valve arrangement sets the water temperature of the mixed water below a third temperature value. This prevents the temperature of the water introduced into the sanitary facility from being too hot. For example, the third temperature value can be 30° C.

In an advantageous way, the valve arrangement primarily takes water from the cold water supply line or the hot water supply line whose water temperature has exceeded or fallen below the limit value. This avoids unnecessary flushing quantities of water from the pipe in which the temperature of the water fed into it is OK. This control can be easily achieved with a valve arrangement with two separate valves. In the case of a mixing valve, a temperature specification can also be transferred from the controller to the mixing valve in order to drain off preferably cold or preferably warm water.

The technical problem shown above is also solved by a toilet flush with a flushing device described above, with a cistern for receiving a predetermined quantity of water and with a cistern valve arrangement for, preferably surge-like, draining of at least part of the quantity of water contained in the cistern for flushing a toilet, wherein the cistern valve arrangement permits electrical actuation, wherein the controller transmits the control signal to the cistern valve assembly, wherein the cistern valve assembly discharges water from the cistern in a conventional manner, and wherein a water level measuring means deactivates the valve assembly of the flushing device upon reaching a predetermined water level within the cistern.

Thus the control of the flushing valve transmits the control signal to the cistern valve arrangement and the water drain triggered by the cistern valve arrangement stops the valve arrangement of the flushing device, for example by means of a float mechanism. The control unit thus initiates the flushing process of the toilet flush, which is then terminated in the conventional manner by the mechanics or electromechanics of the cistern, for example by the control unit switching off the control signal for the flushing device. Thus an equal amount of mixed water triggered by the flushing device is discharged from the cold and warm water pipes, respectively, wherein in borderline cases only cold water or only warm water can be discharged from the flushing device.

The technical problem described above is also solved by a toilet flush with a flushing device described above, with a cistern for holding a given quantity of water, with a cistern valve arrangement for, preferably, a surge-like draining at least a part of the quantity of water contained in the cistern for flushing a toilet, and with an overflow for draining from the cistern water contained above a predetermined water level in the cistern without actuating the cistern valve arrangement, wherein the controller transmits the control signal to the flushing device, wherein the flushing device discharges water into the cistern via the water drain, and wherein water drains from the cistern via the overflow.

It is intended that the controller transmits the control signal directly to the valve arrangement and both opens (activates) the valve arrangement by the control signal and closes (deactivates) it again by switching over the control signal. Thus the water flow from the flushing device into the cistern is not dependent on the filling level of the cistern, but is determined solely by the controller. The water present in the cistern at the beginning of a flushing process is therefore not drained in a specified quantity by the cistern valve arrangement, but the quantity of water drained by the flushing device is drained from the specified water level via the overflow inside the cistern.

This is an advantageous way of ensuring that only the amount of water required to meet the temperature criteria is discharged. This quantity can be smaller or larger than a normal flushing process of a cistern, approx. 6 to 9 litres. The water quality can thus be better controlled and maintained.

Another advantage is that the amount of water discharged is uniform and does not surge. This means that less noise is generated during an automatic flushing process, which could have a disturbing or irritating effect on people in the vicinity.

The technical problem shown above is also solved by urinal flush with a flushing device described above. This achieves the same benefits as previously described for the toilet flush.

In the following, the invention will be explained using examples of execution with reference to the drawing. Show in drawing FIG. 1 a schematic representation of a flushing device according to the invention for a sanitary device, in particular a toilet flush or n urinal flush, FIG. 2 a toilet flush according to the invention with a flushing device as shown in FIG. 1, and FIG. 3 a schematic representation of a toilet flush according to FIG. 2 in a water supply system on one floor.

In the following description of the different embodiments according to the invention, the same components are provided with the same reference marks, even if the components may differ in their dimensions or shape in the different embodiments.

FIG. 1 shows a flushing device 2 for a sanitary device 4, which is shown schematically as toilet flush. The flushing device is connected to a cold water supply line 6 and to a hot water supply line 8. Furthermore, there is a valve arrangement 10 for the inlet of the water flowing in through the cold water pipe 6 and the hot water pipe 8 and a water drain 12 for draining the water flowing in through the valve arrangement 10.

FIG. 1 also shows that a temperature sensor 14 or 16 is provided for measuring the water temperature in the cold water supply line 6 or the warm water supply line 8 and for generating at least one temperature signal $T_K$ or $T_W$. The temperature signals $T_K$ or $T_W$ are fed to a controller 18, which generates a control signal S depending on the temperature signals $T_K$ or $T_W$ to actuate the valve arrangement 10. The control signal S then causes the valve arrangement 10 to drain water through the water drain 12, depending on the control signal S. As explained below, the valve arrangement 10 can be actuated directly or indirectly by the control signal S.

The valve arrangement 10 shown in FIG. 1 can either have two separate valves or be designed as a mixing valve. The symbol used in FIG. 1 should apply equally to both variants. If two separate valves are provided, the two lines 6 and 8 can be flushed separately in a simple manner. If the valve is designed as a mixing valve, then the valve can either be equipped with an expansion element or be electrically operated. When used with an expansion element, there is no need for an electrical power supply to adjust the mixing ratio between hot and cold water; the expansion element is then mechanically adjusted to a specified temperature. When used with an electric actuator, the mixing valve can be controlled more accurately and variably.

The function of the flushing device shown in FIG. 1 can be described as follows.

On the one hand, it is provided that the temperature sensor 14 measures the temperature of the water in the cold water supply line 6 and that the controller 18 generates a control signal $S_1$ when the water temperature $T_K$ exceeds a first temperature limit value $T_1$.

On the other hand, the temperature sensor 16 measures the temperature of the water in the hot water supply line 8 and the controller 18 generates the control signal $S_2$ when the water temperature falls below the $T_W$ temperature limit value $T_2$.

The control unit 16 can thereby generate the control signal $S_1$ or $S_2$ depending on the duration of exceeding or falling below the first or second temperature limit value. Thus fluctuations in the temperature measurement or the temperature development can be compensated.

Depending on the design of the valve arrangement, the signal strength or coding of the control signals $S_1$ or $S_2$ described may be identical or different.

For example, if valve arrangement 10 has two separate valves, control signal $S_1$ can control the operation of valve 10*a* connected to cold water line 6 and control signal $S_2$ can control the operation of valve 10*b* connected to hot water line 8. However, if both control signals $S_1$ and $S_2$ are the same and can be referred to as control signal S, then both valves 10*a* and 10*b* are controlled equally by the common control signal S. The control signal S is the same for both valves. The valves 10*a* and 10*b* are controlled electromechanically in the known way.

If, on the other hand, the valve arrangement 10 is designed as a mixing valve and represents a mixing fitting, then the two control signals $S_1$ and $S_2$ can also be identical or different in their signal strength or coding. If different control signals $S_1$ or $S_2$ are used, the valve arrangement 10 can either drain only or preferably either cold water or hot water. If, on the other hand, only one common control signal is used as described, then valve arrangement 10 is controlled in the same way, regardless of which water pipe produces a corresponding temperature signal $T_K$ or $T_W$. Here, too, the mixing valve is controlled electromechanically in the known way.

In both valve arrangement 10 configurations described above, it can set the water temperature of the mixed water below a third temperature value $T_3$ on the basis of the control signal S or the control signals $S_1$ or $S_2$. This serves in particular to avoid too high a temperature of the water admitted into the cistern.

Furthermore, by using the control signals $S_1$ or $S_2$, it can also be achieved that the valve arrangement 10 draws water primarily from the cold water supply line 6 or the hot water supply line 8, depending on in which of the lines 6 or 8 the water temperature has exceeded or fallen below the temperature limit value $T_1$ or $T_2$. Thus the pipe in which the water temperature requires a flushing process is preferably flushed.

Figure 2:
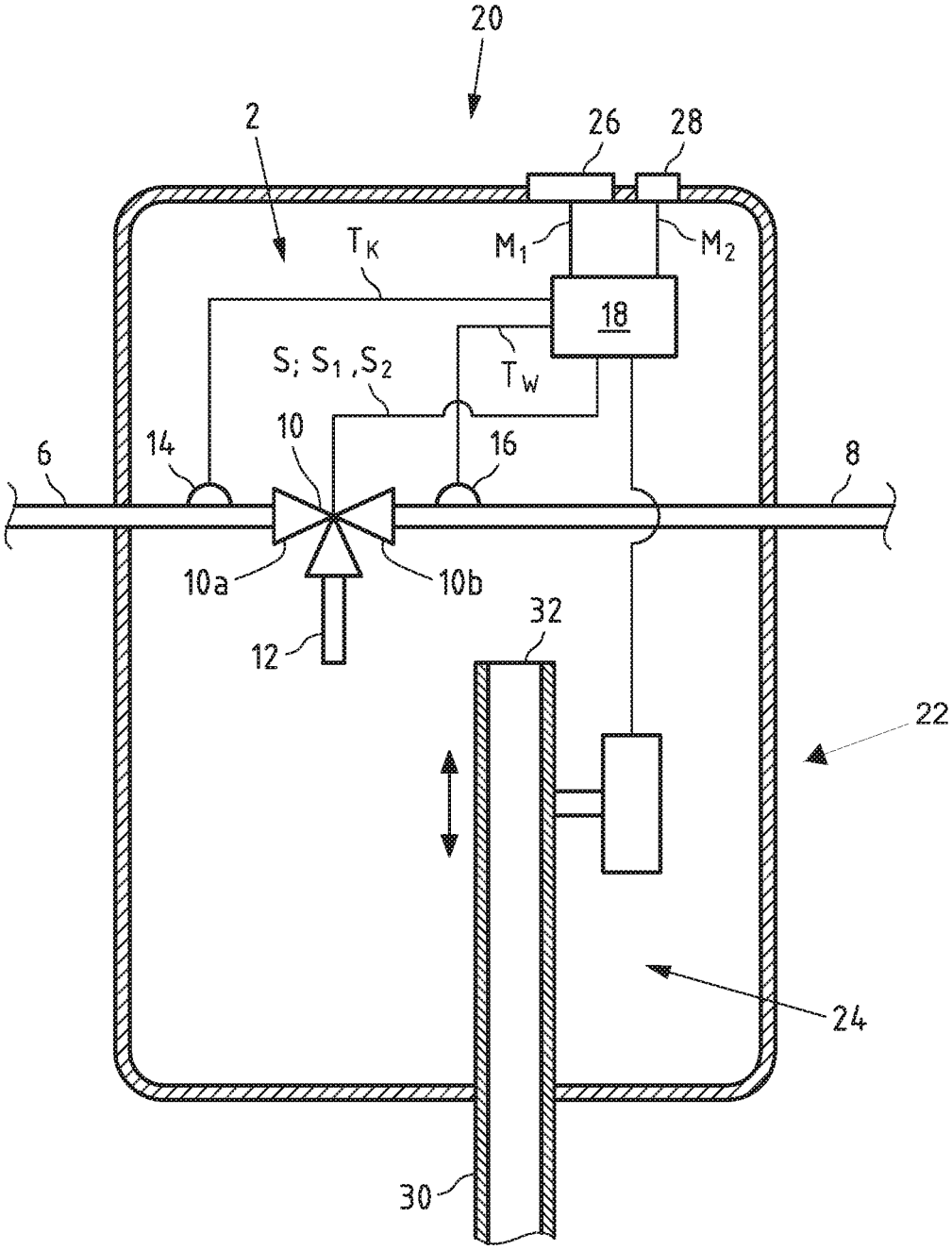
Figure 3:
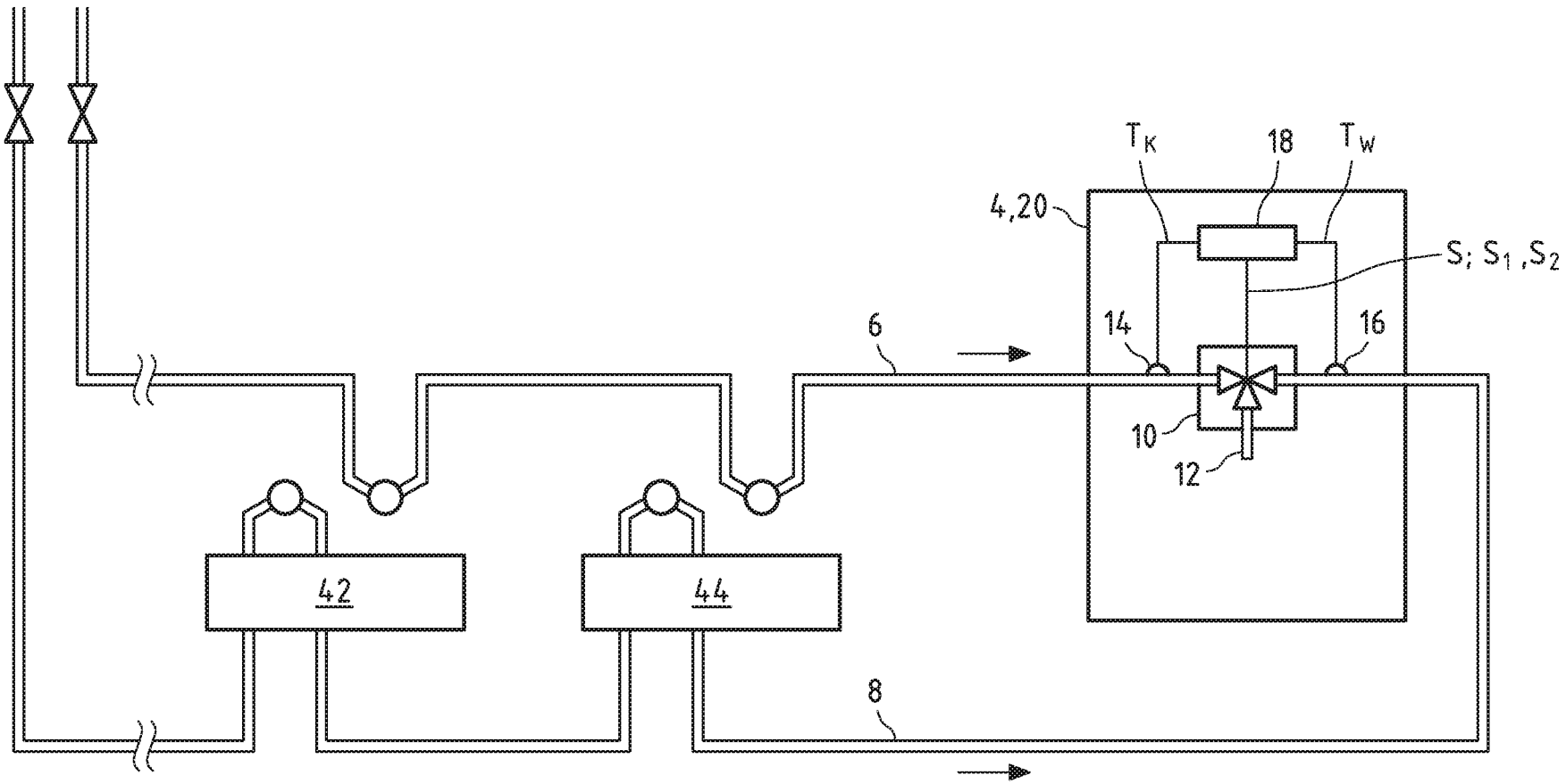

FIG. 2 shows a toilet flush 20 according to the invention with a flushing device 2 previously described using FIG. 1. The toilet flush 20 has a flushing cistern 22 for holding a specified quantity of water in the known manner, and a cistern valve arrangement 24 for surge discharging at least a portion of the amount of water contained in the cistern 22 for flushing a toilet. The cistern valve arrangement 24 is electromechanically designed and enables electrical actuation depending on a control signal. For this purpose, the controller 18 generates the control signal S or $S_1$ or $S_2$ and transmits it to the valve arrangement 10 and to the cistern valve arrangement 24.

The cistern valve arrangement 24 drains water from cistern 22 depending on the control signal S or $S_1$ or $S_2$ and at the same time the flushing device 2 with the valve arrangement 10 drains water into the cistern. A conventional water level measuring device, for example a float (not shown), then deactivates the valve arrangement 10 when a predetermined water level is reached within the cistern 22. For this purpose, a signal is generated by the water level measuring device, which signal is evaluated by the controller and switches over the control signal S or $S_1$ or $S_2$ when the predetermined water level is reached. Thus the flushing device 2 is indirectly switched off by the water level measuring device.

Thus the toilet flush 20 shown is capable of the controller 18 transmitting the control signal $S_1$ or $S_2$ to the cistern valve arrangement 24 and of the water drain triggered by the cistern valve arrangement 24 indirectly actuating the valve arrangement 10 and terminating the water supply. In this way, each time a detected temperature deviation occurs, the toilet flush 20 is activated and a preset amount of water is released.

If a sufficient quantity of cold or warm water has been delivered in the manner described above, a new flushing process is only triggered when the temperature exceeds or falls below the respective limit value. However, if the quantity of water has not been sufficient to bring the temperature in the cold water pipe 6 and/or in the hot water pipe 8 into the specified range, then one or more further flushing processes can be triggered by the controller.

As FIG. 2 further shows, two common keys 26 and 28 are provided for manual actuation of the toilet flush 20, which, when actuated, trigger a corresponding control signal $M_1$ or $M_2$ to controller 18. The two switches 26 and 28 can trigger a short and a full flush in the usual way.

The toilet flushing modes described above each lead to draining a specified amount of water through the drain 30.

The toilet flush described above can also be operated in an alternative way. In addition to the features described above, toilet flush 20 usually has an overflow 32 for draining water from cistern 22 beyond a specified water level in cistern 22 without actuating cistern valve arrangement 24.

The control 18 transmits the control signal S or $S_1$ or $S_2$ to the flushing device 10, so that the flushing device 10 delivers water to the flushing cistern 22 via the water drain 12. Water from cistern 22 then drains from a given water level via overflow 32. Thus, for flushing the cold water line 6 and/or the warm water line 8, a required quantity of water is drained into the cistern 22 and via the overflow 32 into the drain 30 without having to actuate the cistern valve arrangement 24. Thus a surge-like outlet of water can be avoided and only the amount of water necessary for sufficient flushing of pipes 6 and/or 8 is drained.

Thus the toilet flush 20 is designed in such a way that the controller 18 transmits the control signal S or $S_1$ or $S_2$ directly to the valve arrangement 10 and directly controls the starting and stopping of the water supply.

For this purpose, the controller 18 is set up in such a way that when the first or second temperature limit value $T_1$ and/or $T_2$ is reached again, the control signal S or $S_1$ or $S_2$ is deactivated. Thus, the amount of water to be drained can be adjusted very precisely to the temperature conditions.

The toilet flush shown above can also be designed in the same way as urinal flush with a flushing device 2 according to FIG. 1.

FIG. 3 shows the above described flushing device 2 and toilet flush 20 in a water supply system 40 on one floor of a residential house. A supply line 6 for cold water and a supply line 8 for hot water are installed on the floor. The lines 6 and 8 are shown interrupted and only the last bathroom of the floor along the lines 6 and 8 is shown. In this bathroom both pipes are connected exemplarily with a sink 42 and with a shower 44, so that water can be taken out there. At the end of the installation, lines 6 and 8 are connected to a toilet flush 20 described above.

If no water has been taken from pipes 6 and 8 due to an empty bathroom or a prolonged non-use of the bathroom shown, the temperature is equalised with the ambient temperature. As a result, the temperature of the water contained in pipes 6 and 8 may exceed or fall below the specified limit values $T_1$ and/or $T_2$ as described. In one of the ways described, the toilet flush 20 or the flushing device 2 can then be operated in such a way that water is automatically drawn from pipes 6 and/or 8. A long-lasting stagnation of the water in the pipe and the possible hygienic disadvantages can thus be avoided effectively and with low water and energy consumption.

The invention claimed is:

1. A flushing device for a sanitary device, in particular a toilet flush or an urinal flush, with a cold water supply line, with a hot water supply line, with a valve arrangement for admitting the water flowing in through the cold water supply line and the hot water supply line, and with a water drain for draining the water admitted through the cold water supply line and the hot water supply line, wherein at least one temperature sensor is provided for measuring the water temperature in the cold water supply line and/or the hot water supply line and for generating at least one temperature signal, wherein a controller for actuating the valve arrangement generates a control signal as a function of the temperature signal and wherein the valve arrangement drains water through the water drain depending on the control signal, characterized in that the controller transmits the control signal to a cistern valve arrangement, and in that the cistern water drain triggered by the cistern valve arrangement actuates the valve arrangement, such that the controller is capable of activating the valve arrangement both directly and indirectly.

2. The flushing device according to claim 1, wherein the valve arrangement has two separate valves or is designed as a mixing valve.

3. The flushing device according to claim 1, wherein the temperature sensor measures the temperature of the water in the cold water supply line and the controller generates the control signal when the water temperature exceeds a first temperature limit value.

4. The flushing device according to claim 1, wherein the temperature sensor measures the temperature of the water in the hot water supply line and in that the controller generates the control signal when the water temperature falls below a temperature limit value.

5. The flushing device according to claim 1, wherein the controller generates the control signal as a function of the duration of a first or a second temperature limit value being exceeded or undershot.

6. The flushing device according to claim 5, wherein the valve arrangement sets the water temperature of the mixed water below a third temperature value.

7. The flushing device according to claim 1, wherein the valve arrangement takes water primarily from the cold water supply line or the hot water supply line, depending on in which of the lines the water temperature has exceeded or fallen below a temperature limit value.

8. The flushing device according to claim 5, wherein the controller deactivates the control signal when the first or second temperature limit value is reached again.

9. A method for flushing a toilet having a cold water supply line and a hot water supply line, a valve arrangement for admitting the water flowing in through the cold water supply line and the hot water supply line, the valve arrangement having a water drain for draining the water admitted in through the cold water supply line and the hot water supply line, a cistern for receiving a predetermined quantity of water and a cistern valve arrangement for draining at least a part of the amount of water contained in the cistern for flushing the toilet, wherein the cistern valve arrangement allows an electrical actuation, the method comprising transmitting via a controller a first control signal to the valve arrangement and a second control signal to the cistern valve arrangement, the first and second control signals generated as a function of a temperature signal from at least one temperature sensor measuring the water temperature in the cold water line and/or the hot water supply line, draining water from the cistern via the cistern valve arrangement, and deactivating the valve arrangement upon reaching a predetermined water level within the cistern via a water level measuring device.

10. A system for flushing a toilet, comprising:

a cold water supply line, a hot water supply line, a valve arrangement for admitting the water flowing in through the cold water supply line and the hot water supply line, the valve arrangement having a water drain for draining the water admitted in through the cold water supply line and the hot water supply line, at least one temperature sensor configured to measure the water temperature in the cold water supply line and/or the hot water supply line and to generate at least one temperature signal, a controller for actuating the valve arrangement configured to generate a control signal as a function of the temperature signal, a cistern for receiving a predetermined quantity of water, a cistern valve arrangement for draining at least a part of the amount of water contained in the cistern for flushing the toilet, and an overflow for draining water contained in the cistern beyond a predetermined water level from the cistern without actuation of the cistern valve arrangement, wherein the controller transmits the control signal to the valve arrangement, wherein the valve arrangement discharges water into the cistern via the water drain, and wherein water from the cistern drains via the overflow.

11. The flushing device according to claim 1, wherein the device is applied to a urinal.

* * * * *